US006722584B2

(12) United States Patent
Kay et al.

(10) Patent No.: US 6,722,584 B2
(45) **Date of Patent: *Apr. 20, 2004**

(54) COLD SPRAY SYSTEM NOZZLE

(75) Inventors: Albert Kay, Wadsworth, OH (US); Jeganathan Karthikeyan, Akron, OH (US)

(73) Assignee: ASB Industries, Inc., Barberton, OH (US)

( * ) Notice: Subject to any disclaimer, the term of this patent is extended or adjusted under 35 U.S.C. 154(b) by 227 days.

This patent is subject to a terminal disclaimer.

(21) Appl. No.: 09/683,204

(22) Filed: Nov. 30, 2001

(65) Prior Publication Data

US 2002/0033135 A1 Mar. 21, 2002

Related U.S. Application Data

(63) Continuation-in-part of application No. 09/847,970, filed on May 2, 2001.

(51) Int. Cl.[7] ..... B05B 7/04

(52) U.S. Cl. ..... 239/434; 239/594; 239/596; 239/597; 239/600; 239/433; 51/439

(58) Field of Search ..... 239/596, 597, 239/600, 601, 590.5, 592, 594, 430, 434, 433, 320, 439, 79, 80, 85; 51/439, 320; 451/102

(56) References Cited

U.S. PATENT DOCUMENTS

| | | | | |
|---|---|---|---|---|
| 2,672,187 A | * | 3/1954 | Smith | 239/587.1 |
| 3,194,191 A | * | 7/1965 | Hawk, Sr. | 239/128 |
| 3,415,450 A | * | 12/1968 | Hawk, Sr. | 239/311 |
| 4,817,342 A | * | 4/1989 | Martin et al. | 51/439 |
| 5,302,414 A | | 4/1994 | Alkhimov et al. | |
| 5,597,458 A | | 1/1997 | Sanchez, Jr. et al. | |
| 5,795,626 A | | 8/1998 | Gabel et al. | |
| 5,901,908 A | | 5/1999 | Goenka et al. | |
| 6,502,767 B2 | * | 1/2003 | Kay et al. | 239/433 |

* cited by examiner

*Primary Examiner*—Dinh Q. Nguyen
(74) *Attorney, Agent, or Firm*—Buckingham, Doolittle & Burroughs; Louis F. Wagner

(57) ABSTRACT

The invention relates to an improved design for a spray gun and application system for cold gas dynamic spraying of a metal, alloy, polymer, or mechanical mixtures thereof. The gun includes a rear housing comprising a powder inlet and a gas inlet, a front housing removably affixed to the rear housing and comprising an mixing cavity therein for mixing of the powder and gas and an exit therefrom, a nozzle holder having a bore disposed therethrough and removably affixed to the front housing, and a nozzle positioned within the nozzle holder, an interior taper of the nozzle holder bore complementing an exterior taper of the nozzle, said nozzle having an initially converging, subsequently diverging centrally disposed bore therein adapted to receive the mixed powder and gas from the mixing chamber.

27 Claims, 3 Drawing Sheets

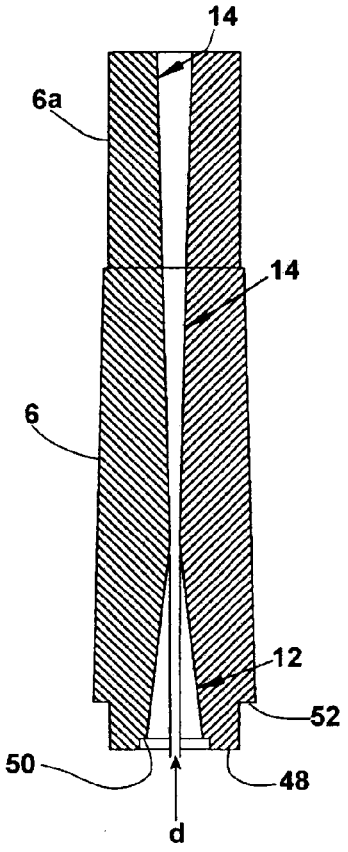
FIG. - 3
FIG. - 4
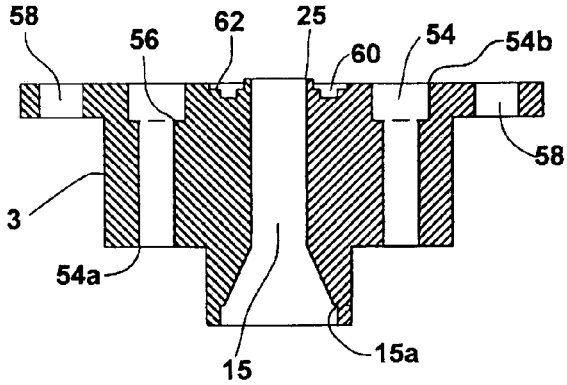
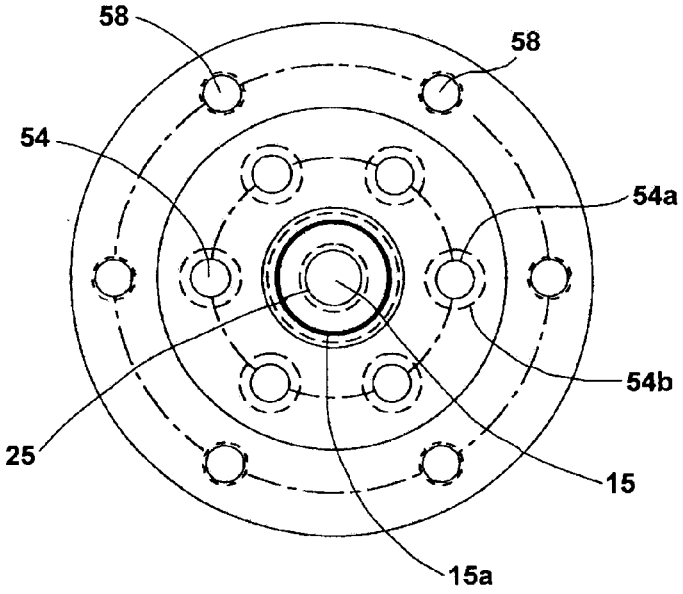
FIG. - 5

COLD SPRAY SYSTEM NOZZLE

BACKGROUND OF INVENTION

The invention relates to an improved design for a spray nozzle and application system for cold gas dynamic spraying of a metal, alloy, polymer, or mechanical mixtures thereof. The gas and particles are formed into a supersonic jet having a temperature below the fusing temperature of the powder material, the jet being directed against an article which is to be coated.

There are various features which characterize a typical cold spray system of the Prior Art as illustrated in U.S. Pat. No. 5,302,414. The nozzle has been typically made of two halves for ease of fabrication. Clamps or bolt and nuts are used at multiple locations along the length to clamp the two halves together and ensure leak tightness. Such multiple point clamping of the nozzle, which is heated by the high temperature gas flowing through the nozzle, results in warping of the nozzle halves. This causes gas leakage between the two halves. The nozzle is attached to a 3–5 mm thick washer and this washer is bolted onto the gun body. Bolting the washer onto the gun body provides metal to metal seal at the injection point. This arrangement again causes warping of the washer and uneven bolting pressure results in gas and powder leakage between the gun body and the nozzle at the mating point. The entire gun body, consisting of the inlet chamber, gas and powder injection ports, mixing chamber and the diffuser, is welded together to form a single monolithic gun body. Thorough cleaning of the gun almost impossible. Moreover damage to any small part, like the diffuser, necessitates the whole gun body to be replaced.

In general, a bulky and heavy electrical heater is used to heat the large volume processing gas. Typical designs used today require the gun to be mounted right onto the heater. This arrangement necessitates that, in order to scan the substrate surface to produce a coating, either one has to move the substrate or move the whole heater-and-gun assembly. In many occasions, moving the substrate is not possible. Moving the gun and the heater assembly requires a heavy duty robot or manipulator and also restricts freedom of movement of the spray beam. Thus, the flexibility of the spray operation is highly restricted in this arrangement.

The heater normally heats the gas to as high as 1300° F. The electric heating element, used to heat the process gas, operates under high pressure and temperature environment. During the spraying of some materials such as aluminum, the powder particles get deposited inside the nozzle on the walls blocking the gas flow path. When the nozzle block happens, the gas flow is reduced or even stopped causing abnormal increase in the temperature and pressure of the heating element and the gun. Such sudden increase in temperature and pressure can damage the gun and the heater, and also affect the safety of the operator.

The Prior Art is limited in both nozzle design and system configuration By using the novel design of the present invention, coupled with the new system arrangement of the essential elements of the invention, a more flexible configuration is shown which overcomes the inherent limitations of the teachings of the Prior Art as well as permitting a wider range of applications, not permitted with the presently available systems.

SUMMARY OF INVENTION

The invention eliminates many of the inherent limitations of the Prior Art by redesigning the nozzle which minimizes warpage at operating temperatures and a leak-tight joint, yet is still made of two halves for ease of fabrication. This new design uses a tapered cylindrical nozzle, in contrast to the rectangular nozzle design of the Prior Art. The cylindrical nozzle is held in place by a cylindrical nozzle holder with a complementary internal taper to that of the external taper of the nozzle, holding the two halves of the nozzle in position and sealing the joint with a uniform application of pressure over the entire length of the nozzle. In light of the fact that the nozzle holder is larger than the nozzle, it remains cooler than the nozzle, which expands due to the hot gas passing internally therein, thereby additionally facilitating the leak-proof fit of the nozzle to the nozzle holder. The invention additionally capitalizes on a remote gas heating step, which permits the disassociation of the heater mechanism from that of the main body of the gun, thereby permitting more flexibility in the application of the spray gun and allowing applicability in deposition geometries which would have been physically precluded by the Prior Art.

It is an object of this invention to improve the fluid dynamics at the nozzle.

It is another object of this invention to heat the gas and/or gases at a location remote from the spray gun which permits greater flexibility in system design for application onto substrates.

It is yet another object of this invention to enhance and/or maintain the leak-tight characteristics of the nozzle over time due to the improved design of the nozzle.

These and other objects of this invention will be evident when viewed in light of the drawings, detailed description, and appended claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein:

FIG. 3 is an enlarged cross-sectional view of a single-component nozzle;

FIG. 4 is a cross-sectional view of an alternative embodiment front housing for use with the single-component nozzle of FIG. 3; and FIG. 5 is a bottom elevational view of the front housing of FIG. 4.

DETAILED DESCRIPTION

Figure 1:
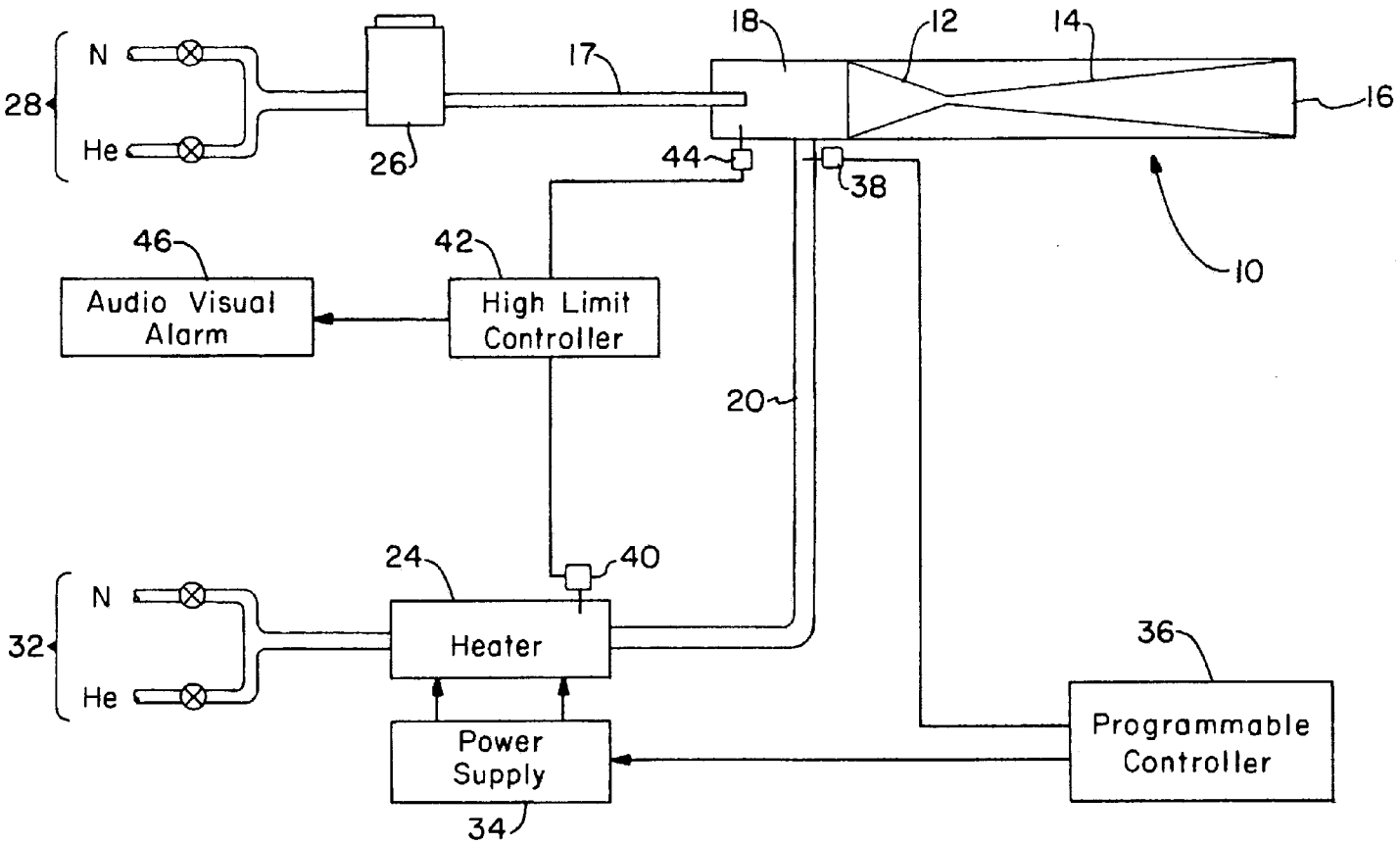
FIG. 1 is a schematic of the cold gas-dynamic spray system.

Referring now to the drawings wherein the showings are for purposes of illustrating the preferred embodiment of the invention only and not for purposes of limiting the same, the Figures show the process and apparatus used in the process to effect deposition of various materials onto a substrate.

In the process illustrated in FIG. 1, two high pressure gas streams 28, 32, said streams either being the same or different, or even mixed streams of the two high pressure gases, are fed in a predefined ratio, said ratio being determined by a number of factors, including the rate of powder delivery, the gas velocity, the diameter of the tubing, etc., into powder hopper 26 and gas heating chamber 24. It is recognized that while two separate high pressure gas streams are shown, it is possible to configure the system to use only one source of high pressure gas with a splitter valve, not shown. In this configuration, the composition of the high pressure gases fed to the powder hopper and gas heating chamber would be the same. The gas heating chamber may be a straight pass through furnace or include a serpentine or helical path. The heating means may be by ceramic cartridge heaters, flame, heat exchanger tubes, electrical heating, or by any other known heating means. The heated gas exits the heater via exit flexible insulated metal hose 20 into the nozzle assembly 10 via gun body 18, where it combines with a predetermined quantity of powder which has been picked up from the powder hopper 26 via flexible powder hopper feed tube 17.

Figure 2:
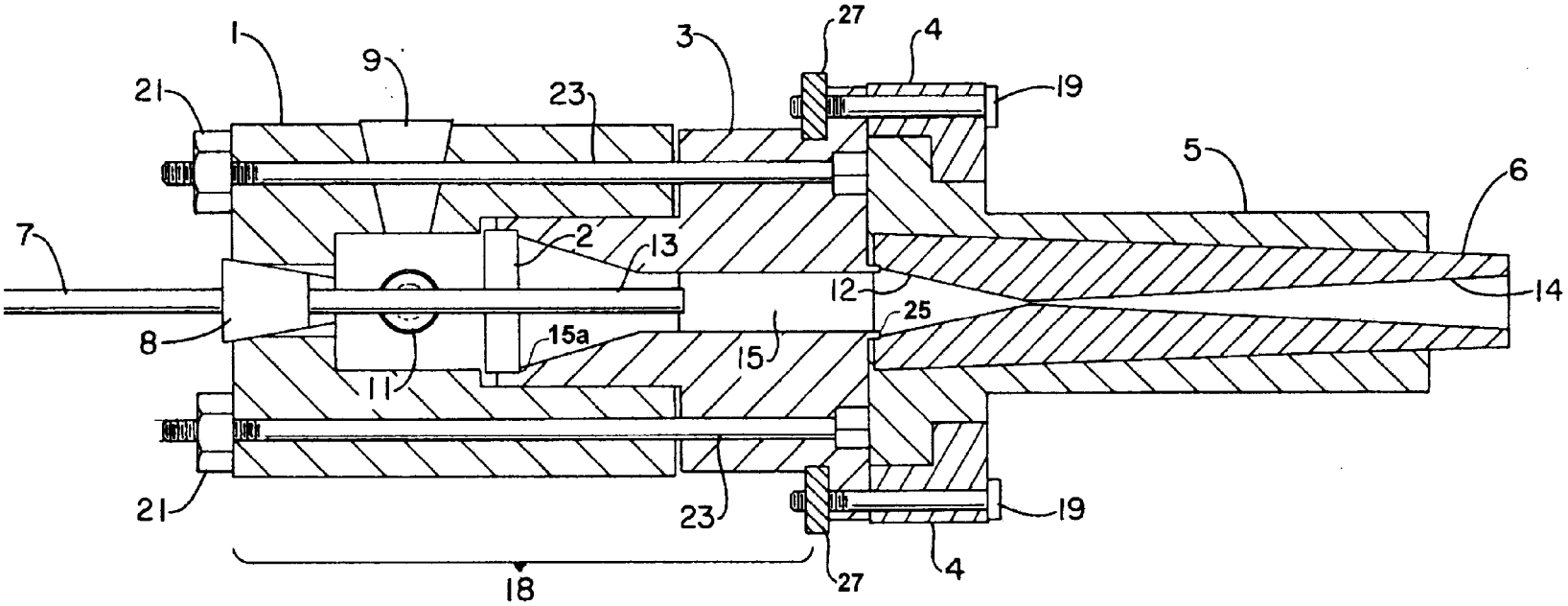
FIG. 2 is a side view, shown in partial cross-section, of a spray gun used in the practice of the invention shown in FIG. 1.

The spray gun unit is best illustrated in FIG. 2 and has a modular structure for the ease of fabrication, operation and cleaning the gun. In a preferred embodiment, the spray gun includes at least four main components: a rear housing 1, a front housing 3, a nozzle holder 5 and a nozzle 6. Rear housing 1 contains two inlets, one inlet for the gas entrained powder 7 and the other for the heated gas resident in flexible insulated metal hose 20 via gas entry port 9. An adjustable coupling 8 allows control of the length of the extending portion 13 of the gas entrained powder through powder feed tube 7 into the mixing chamber 15 to fine tune performance characteristics of the system. A diffuser 2 facilitates the high speed mixing of the heated inlet gas from flexible metal hose 20 via entry valve 9 with the gas entrained powder from the powder feed tube 7 in the front housing 3. The mixing of the heated gas with entrained powder occurs in mixing chamber 15 with egress into a converging 12/diverging 14 nozzle to impart supersonic velocities to the gas and entrained powder particles for ultimate impingement upon a substrate. Described similarly and alternatively, the initially converging circular bore of the nozzle may be viewed as frustoconical in shape while the diverging circular bore of the nozzle may be viewed as inverted frustoconical in shape, each frustoconical shape in communication with each other via restricted channel, and in a preferred embodiment, by co-joining of the frustoconical shapes. In a preferred embodiment, the nozzle holder is removably affixed to the housing by annular ring 4 having at least two internal diameters, a larger of said at least two internal diameters positioned toward said housing, an exterior periphery of the nozzle holder in mating contact with the ring and at least two removable fastening means for removable engagement of the ring with the housing.

Diagnostic ports measure and control gas pressure and temperature and are incorporated at the mixing chamber. High-pressure (up to 30 bar/500 psi) gas (air, nitrogen, helium and their mixtures) is used as the working gas. In order to compensate for the cooling associated with the rapid expansion at the nozzle, an electric heater 24 is used to preheat the working gas to about 200–700° C. (400–1300° F.). A high-pressure powder hopper feeds powder material in the size range of 10–40 microns. Conventional job handling systems such as robot, x-y manipulator, lathe, etc. are used to scan the spray beam over the substrate surface to produce the coating.

The nozzle is designed to ensure less warpage, and therefore a more leak-tight joint. The nozzle is made of two halves for ease of fabrication. However, the nozzle shape has been changed from rectangular of the Prior Art to that of a tapered cylinder 6. The shape of the nozzle holder 5, has also been modified from a rectangular washer to a cylinder with complimentary taper on the internal diameter to that of the external diameter of the nozzle and is used to hold and clamp the two halves of the nozzle and seal the joint. This arrangement ensures a uniform pressure over the entire length of the nozzle holder 5 and nozzle 6 and thereby providing a leak-tight seal. Moreover, since the nozzle holder has larger dimensions and remains cooler than the nozzle, the larger expansion of the nozzle, generated by the hot gas only helps in increasing the sealing force as the nozzle 6 tries to expand into the bore of the cooler nozzle holder 5. Warping of the nozzle halves due to high temperature is also avoided, since the clamping force is uniform over the whole length of the nozzle due to the complementary tapers of the exterior of the nozzle and the interior bore of the nozzle holder.

In an alternative embodiment, the nozzle is of a single component design, unlike the nozzle halves described above. In this embodiment illustrated in FIG. 3, the nozzle retains a portion of the exteriorly tapered design 6, but optionally has a second longitudinally extending segment 6*a* having essentially parallel cylindrical sides. As in the previous configuration, a nozzle holder 5 is designed to overlap the exteriorly tapered design 6 of the nozzle. Through the complementary taper on the interior diameter of the nozzle holder 5 with the external taper of at least a portion of the nozzle 6, substantially uniform pressure is maintained over a substantial portion of the nozzle. The single component nozzle retains the internal bore converging 12/diverging 14 frustoconical characteristics to impart supersonic velocities to the gas and entrained powder particles for ultimate impingement upon a substrate. The initially converging circular bore of the nozzle and the diverging circular bore of the nozzle are in continuous communication via restricted channel or throat having an internal diameter d. The entire internal bore of the nozzle is diamond-paste honed to provide a highly polished surface therein. In one aspect of the invention, the entrance end of the nozzle has an internal shelf 50 for seating engagement with a circular lip 25 of mixing chamber 15. Cylindrical lip 48 of the nozzle is dimensioned so as to matingly engage with shelf 62 of corresponding cylindrical depressions 60 in front housing 3 having a high-temperature O-ring positioned therein (not shown) as illustrated in FIG. 4. This embodiment provides a still further leak-proof attachment mechanism for the entrained powder particles.

The nozzle 6 of either embodiment (FIGS. 2 and 3) and nozzle holder assembly 5 are attached to the gun body using a large dimension ring 4 with associated bolts 19 and nuts 27. Positioning of the nozzle and nozzle holder assembly is effected through at least partial mating engagement with circular lip 25 which is at least partially inserted into nozzle bore inlet and at least partial mating engagement with circular lip 48 of the nozzle which is at least partially inserted into cylindrical depressions 60 of front housing 3 having an O-ring disposed therein. The nozzle ring not only has sufficient strength to withstand the mechanical stresses (unlike the washer of the Prior Art), but also serves as a heat sink so that the nozzle 6 has a lower temperature than the gun body 18. Proper temperature differential between the gun body and the nozzle allows the thermal expansion of the gun body to grow into the nozzle seal groove and enhance the seal at gun body/nozzle interface and avoid any leakage of gas. Thus, this design enhances sealing characteristics at higher operating temperatures. Front housing 3 and rear housing 1 are attached using a set of nuts 27 with associated recessed bolts 23 positioned within longitudinal apertures 54 resting on shelf 56 which facilitates easy and quick disassembly, cleaning, and reassembly. Engagement of the nozzle assembly 10 with that of gun body 18 is effected by nuts 27 and bolts 19 through cylindrical apertures 58.

As illustrated in FIG. 5, multiple nuts and bolts are used to secure the entire assembly together, some fastening combinations being flush with the surface as illustrated by nut 21/bolt 23 combination configured within cylindrical aperture 54 having a recessed head component 54*b* and non-recessed component 54*a*.

Rear housing 1 contains both gas 9 and powder 7 inlets. It also contains ports for monitoring the pressure and temperature of the process gas. The exact position of the powder inlet can be adjusted by use of the adjustable coupling nut 8 shown in FIG. 2. The diffuser 2 not only helps in the formation of a proper jet but also ensures that the powder is injected exactly coaxially. The front housing removably couples the gas and powder inlets to the converging/diverging nozzle. It serves to form the gas jet and properly mix the powder and gas, so that the proper spray beam is produced in the nozzle.

One limitation which has limited the applicability of Prior Art solutions, is the lack of a flexible metal hose, which is capable of high pressure operation, which is now introduced between the heater and the spray gun. This allows the heavy and bulky heater to remain stationary and move only the gun to achieve scanning of the substrate. Moreover, the end couplings of the metallic hoses have been designed so that multiple hoses can be connected in series or parallel combinations to meet the requirements of flexibility and productivity.

The heater 24 consists of a high temperature heating coil embedded in an insulating container, a variable power supply 34 and a programmable temperature controller 36. A Monel® 400 tube (0.5 outer diameter and 0.065 wall thickness) is wound in the form of coil and is used as the heating element. The electric current flowing through the tube heats the coil and this in turn heats the gas flowing through the Monel® tube. The Monel® tube is chosen since it can operate safely at 1500° F. and 800 PSI pressure. For low temperature (less than 600° F.) operations, the Monel® tube can be replaced by a less expensive stainless steel tube.

A simple welding power supply 34 is used to energize the heating coil. As illustrated in FIG. 1, a programmable temperature controller 36 is integrated into the welding power supply to control the temperature of the processing gas. This programmable controller is used to control the operating temperature, heating cooling rates and the duty cycle. It controls the operating temperature within ±5° F. A sealed thermocouple 38 is inserted into the gas stream in close proximity of the gun body to measure the temperature of the processing gas. When the gas temperature rises 20° F. above the set value, the controller 36 switches off the power supply 34 and sends out a signal showing abnormal operation.

The system has been designed to incorporate safety feature for the protection both the system and the operator. As noted earlier, the programmable controller is used to switch off the power supply and send a signal out in case of abnormal increase in the temperature of the processing gas above the set value. A high limit thermocouple 40 is installed onto the heating coil very close to the outlet, so that it will measure the wall temperature of the heating coil. This thermocouple is connected to the high limit temperature input of a high limit controller 42.

Apart from the dial gauge to read the operating pressure of the gun, a solid state pressure sensor 44 is incorporated onto the gun body. This sensor is connected to a pressure regulator wherein the maximum pressure can be set in the range of 100–600 PSI. When the gun pressure exceeds the set pressure, this sends a signal to the high pressure input of the high limit controller 42. When the high limit controller 42 receives either the pressure or the temperature signal, it immediately switches off the heating power supply 34 and gives a audiovisual alarm 46.

A high pressure release vent 11 is incorporated onto the gun body. When the nozzle blockage occurs and the high pressure signal sets off the alarm 46, the gas inlet valve 9 is momentarily closed, vent 11 opened and then the gas valve 9 opened again to cool the heating coil.

8Therefore, what has been described in a preferred embodiment, is an apparatus which comprises multiple parts including a housing (which may itself comprise multiple sub-parts), an inlet for a gas entrained powder, an inlet for a gas, a mixing cavity within the housing for mixing of the powder and gas in communication with the respective inlets therefore, the cavity having an exit for egress of the combined gas/powder stream into a nozzle.

The nozzle is in intimate physcial contact with the housing and affixed thereto by a nozzle holder having a tapered cylindrical bore centrally disposed therethrough, the nozzle holder removably attached to said housing with a fastening means, typically a bolt and a screw although other modes of attachment are envisioned, e.g., elimination of the bolt via an internally threaded bore. In one embodiment, the spray gun nozzle will have at least two halves, in mating engagement with each other, typically mirror-images, and having a centrally disposed bore therethrough when engaged. In an alternate embodiment, the spray gun nozzle will be of unitary construction.

The nozzle bore will have an inlet end and an exit end and a constriction interposed between the two ends. In a preferred embodiment, the inlet end has a right frustoconical shape extending partway therethrough and in communication with an inverted right frustoconical shaped bore exit at an opposed exit end. The nozzle bore is in communication with the mixing cavity exit, and leak-proof engagement is effected by positioning of the nozzle within the bore of the nozzle holder, an interior taper of the nozzle holder bore essentially matching an exterior taper of the nozzle.

The housing for the spray apparatus typically has several subparts, and wherein the inlets for the entrained powder and heated gas is contained within the rear housing while the mixing cavity is within a detachable front housing, secure engagement of the front and rear housings being effected via an attachment means which may be a nut and a bolt, or alternatively an internally threaded bore for receiving mating exteriorly threaded bolt.

In order to facilitate the fastening of the housing with the nozzle, the exit of the mixing cavity has a protruding lip for insertion into an inlet end of said nozzle bore. The altitude (a measure of the height of the frustonconical section as measured between the two bases) of the inlet frustoconical bore is less than an altitude of the exit frustoconical bore.

In order to provide for maximum flexibility in the operation of the spray gun, the inlet for said gas entrained has an adjustable coupling for controlling a length of an extending portion of a tube for the gas entrained powder into the mixing chamber. The housing optionally contains a gas diffuser and a selectively openable vent.

In a preferred embodiment, the nozzle holder fastening means is a ring having at least two internal diameters, a larger of the at least two internal diameters positioned toward the housing, and an exterior periphery of the nozzle holder in mating contact with the ring, fastening being effected by at least two removable fastening means for engagement of the ring with the housing.

This invention has been described in detail with reference to specific embodiments thereof, including the respective best modes for carrying out each embodiment. It shall be understood that these illustrations are by way of example and not by way of limitation.

What is claimed is:

1. An apparatus which comprises:

(a) a housing;

(b) an inlet for a gas entrained powder;

(c) an inlet for a gas;

(d) a mixing cavity disposed within said housing for mixing of said powder and gas in communication with said inlets, said cavity having an exit therefrom;

(e) a nozzle holder having a tapered cylindrical bore centrally disposed therethrough, (i) said nozzle holder removably attached to said housing with a fastening means;

(f) a nozzle having a centrally disposed bore therethrough and further comprising, (i) a nozzle bore having a right frustoconical shape extending partway therethrough at an inlet of said nozzle bore and in communication with an inverted right frustoconical shaped bore exit at an opposed exit end, (ii) said nozzle bore in communication with said mixing cavity exit, (iii) said nozzle positioned within said bore of said nozzle holder, an interior taper of said nozzle holder bore essentially matching at least a portion of an exterior taper of the nozzle; and (g) a high temperature circular sealing means between said nozzle and said housing.

2. The apparatus of claim 1 wherein (a) said inlet for said gas entrained powder is a rear housing;

(b) said inlet for said gas is within said rear housing; and (c) said mixing cavity is within a detachable front housing, and further wherein (i) said apparatus further comprises a means for removably attaching said rear and front housings.

3. The apparatus of claim 1 wherein (a) said exit from said mixing cavity has a mixing cavity protruding lip for insertion into an inlet end of said nozzle bore; and (b) said inlet end of said nozzle bore has a protruding lip for insertion into an annular recess adjacent said mixing cavity, said annular recess having a high-temperature O-ring disposed therein.

4. The apparatus of claim 3 wherein (a) said frustoconical shapes are cojoined within said nozzle bore.

5. The apparatus of claim 4 wherein (a) an altitude of said inlet frustoconical bore is less than an altitude of said exit frustoconical bore.

6. The apparatus of claim 1 wherein said inlet for said gas entrained powder further comprises (a) an adjustable coupling for controlling a length of an extending portion of a tube for said gas entrained powder into said mixing chamber.

7. The apparatus of claim 1 wherein said housing further comprises (a) a gas diffuser.

8. The apparatus of claim 7 wherein said housing further comprises (a) a selectively openable vent.

9. The apparatus of claim 1 wherein said nozzle holder fastening means further comprises (a) a ring having at least two internal diameters, a larger of said at least two internal diameters positioned toward said housing;

(b) an exterior periphery of said nozzle holder in mating contact with said ring; and (c) at least two removable fastening means for engagement of said ring with said housing.

10. An apparatus which comprises:

(a) a housing (b) an inlet for a gas entrained powder;

(c) an inlet for a gas;

(d) a mixing cavity disposed within said housing for mixing of said powder and gas in communication with said inlets, said cavity having an exit therefrom;

(e) a nozzle holder having a tapered cylindrical bore centrally disposed therethrough, (i) said nozzle holder removably attached to said housing with a fastening means;

(f) a nozzle having a centrally disposed bore therethrough and further comprising, (i) a nozzle bore having a constriction at last partway through said bore, (ii) said nozzle bore in communication with said mixing cavity exit at an inlet end of said nozzle bore, (iii) said nozzle positioned within said bore of said nozzle holder, an interior taper of said nozzle holder bore essentially matching at least a portion of an exterior taper of the nozzle; and (g) a high temperature circular sealing means between said nozzle and said housing.

11. The apparatus of claim 10 wherein (a) said inlet for said gas entrained powder is a rear housing;

(b) said inlet for said gas is within said rear housing; and (c) said mixing cavity is within a detachable front housing, and further wherein (i) said apparatus further comprises a means for removably attaching said rear and front housings.

12. The apparatus of claim 10 wherein (a) said exit from said mixing cavity has a protruding lip for insertion into an inlet end of said nozzle bore; and (b) said inlet end of said nozzle bore has a protruding lip for insertion into an annular recess adjacent said mixing cavity, said annular recess having a high-temperature O-ring disposed therein.

13. The apparatus of claim 12 wherein (a) said inlet nozzle bore is frustoconical and said exit nozzle bore is inverted frustoconical, said inlet bore in communication with said exit bore.

14. The apparatus of claim 13 wherein (a) an altitude of said inlet frustoconical bore is less than an altitude of said exit frustoconical bore.

15. The apparatus of claim 10 wherein said inlet for said gas entrained powder further comprises (a) an adjustable coupling for controlling a length of an extending portion of a tube for said gas entrained powder into said mixing chamber.

16. The apparatus of claim 10 wherein said housing further comprises (a) a gas diffuser.

17. The apparatus of claim 16 wherein said housing further comprises (a) a selectively openable vent.

18. The apparatus of claim 10 wherein said nozzle holder fastening means further comprises (a) a ring having at least two internal diameters, a larger of said at least two internal diameters positioned toward said housing;

(b) an exterior periphery of said nozzle holder in mating contact with said ring; and (c) at least two removable fastening means for engagement of said ring with said housing.

19. An apparatus which comprises:

(a) a housing (b) an inlet for a gas entrained powder;

(c) an inlet for a gas;

(d) a mixing cavity disposed within said housing for mixing of said powder and gas in communication with said inlets, said cavity having an exit therefrom;

(e) a nozzle holder having a cylindrical bore centrally disposed therethrough, (i) said nozzle holder removably attached to said housing with a fastening means;

(f) a nozzle insertable at least partway into said nozzle holder and in frictional engagement therewith, (i) said nozzle bore having a constriction at last partway through said bore, and (ii) said nozzle bore in communication with said mixing cavity exit; and (g) a high temperature circular sealing means between said nozzle and said housing.

20. The apparatus of claim 19 wherein (a) said inlet for said gas entrained powder is a rear housing;

(b) said inlet for said gas is within said rear housing; and (c) said mixing cavity is within a detachable front housing, and further wherein (i) said apparatus further comprises a means for removably attaching said rear and front housings.

21. The apparatus of claim 20 wherein (a) said exit from said mixing cavity has a protruding lip for insertion into an inlet end of said nozzle bore; and (b) said inlet end of said nozzle bore has a protruding lip for insertion into an annular recess adjacent said mixing cavity, said annular recess having a high-temperature O-ring disposed therein.

22. The apparatus of claim 21 wherein (a) said inlet nozzle bore is frustoconical and said exit nozzle bore is inverted frustoconical, said inlet bore in communication with said exit bore.

23. The apparatus of claim 22 wherein (a) an altitude of said inlet frustoconical bore is less than an altitude of said exit frustoconical bore.

24. The apparatus of claim 19 wherein said inlet for said gas entrained powder further comprises (a) an adjustable coupling for controlling a length of an extending portion of a tube for said gas entrained powder into said mixing chamber.

25. The apparatus of claim 19 wherein said housing further comprises (a) a gas diffuser.

26. The apparatus of claim 25 wherein said housing further comprises (a) a selectively openable vent.

27. The apparatus of claim 19 wherein said nozzle holder fastening means further comprises (a) a ring having at least two internal diameters, a larger of said at least two internal diameters positioned toward said housing;

(b) an exterior periphery of said nozzle holder in mating contact with said ring; and (c) at least two removable fastening means for engagement of said ring with said housing.

* * * * *